US006593518B2

(12) United States Patent
Hsieh

(10) Patent No.: US 6,593,518 B2
(45) Date of Patent: Jul. 15, 2003

(54) INSTRUMENT PEDAL

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 9 days.

(21) Appl. No.: 09/934,636

(22) Filed: Aug. 23, 2001

(65) Prior Publication Data

US 2003/0037661 A1 Feb. 27, 2003

(51) Int. Cl.[7] ..... G10D 13/02

(52) U.S. Cl. ..... 84/422.1; 84/422.3; 84/422.2

(58) Field of Search ..... 84/422.1, 421, 84/422.2, 422.3

(56) References Cited

U.S. PATENT DOCUMENTS 6,271,450 B1 * 8/2001 Mackie ..... 84/422.1

* cited by examiner

*Primary Examiner*—Kimberly Lockett
(74) *Attorney, Agent, or Firm*—Fei-Fei Chao; Venable, Baetjer, Howard & Civiletti, LLP

(57) ABSTRACT

A instrument pedal has a plate adapted to be inclined and pivotally connected to the base and having a recessed area, an auxiliary plate with a pattern formed on a face of the auxiliary plate and being securely yet detachably received in the recessed area; a stop engaging the first connecting flange of the auxiliary plate to secure the auxiliary plate in the recessed area and a pressing plate provided to engage the second connecting flange of the auxiliary plate to secure the auxiliary plate in the recessed area.

6 Claims, 6 Drawing Sheets

INSTRUMENT PEDAL

BACKGROUND OF THE INVENTION

1. Field of the Invention

The present invention relates to an instrument pedal, and more particularly to an instrument pedal that a portion of the pedal is replaceable so that the maintenance fee for repair is reduced.

2. Description of Related Art

With reference to FIG. 7, a conventional instrument pedal (70) has a first end pivotally connected to a top face of a base and a second end pivotally connected with a beater by means of a connecting element such as a chain. The pedal (70) has a pattern (71) and a stop (72). The pattern (71) is formed on a top face of the pedal (70) to increase friction when the pedal (70) is used. The stop (72) is formed on a top of the pattern (71) so that the user's foot is able to abut against the stop (72) to avoid slipping when the user is using the pedal (70). After a long period of time using the pedal (70), the user will find the pattern (71) is worn due to continuous rubbing between the sole of the user's shoe and the pattern (71), which leads to that the user's foot pedaling on the pedal (70) slips a lot on the pedal (70). In order to overcome the drawback, the only choice is to replace the entire pedal (7) with a new one. However, taking apart the pedal (70) requires a lot of manual work and is time consuming. Furthermore, it is not effective and not economic. Replacing the entire pedal (70) for only the upper face of the pedal (70) is worn is not a cost effective way to solve problems.

Therefore, it is an objective of the invention to provide an improved instrument pedal to solve the foregoing problem in a cost effective manner.

SUMMARY OF THE INVENTION

The primary objective of the invention is to provide an instrument pedal with a replaceable upper place so that the user only needs to change the upper face when worn.

Another objective of the invention is that the upper face has a reduced thickness such that the application of the upper face by the user is ergonomic.

Other objects, advantages and novel features of the invention will become more apparent from the following detailed description when taken in conjunction with the accompanying drawings.

DETAILED DESCRIPTION OF THE PREFERRED EMBODIMENT

Figure 1:
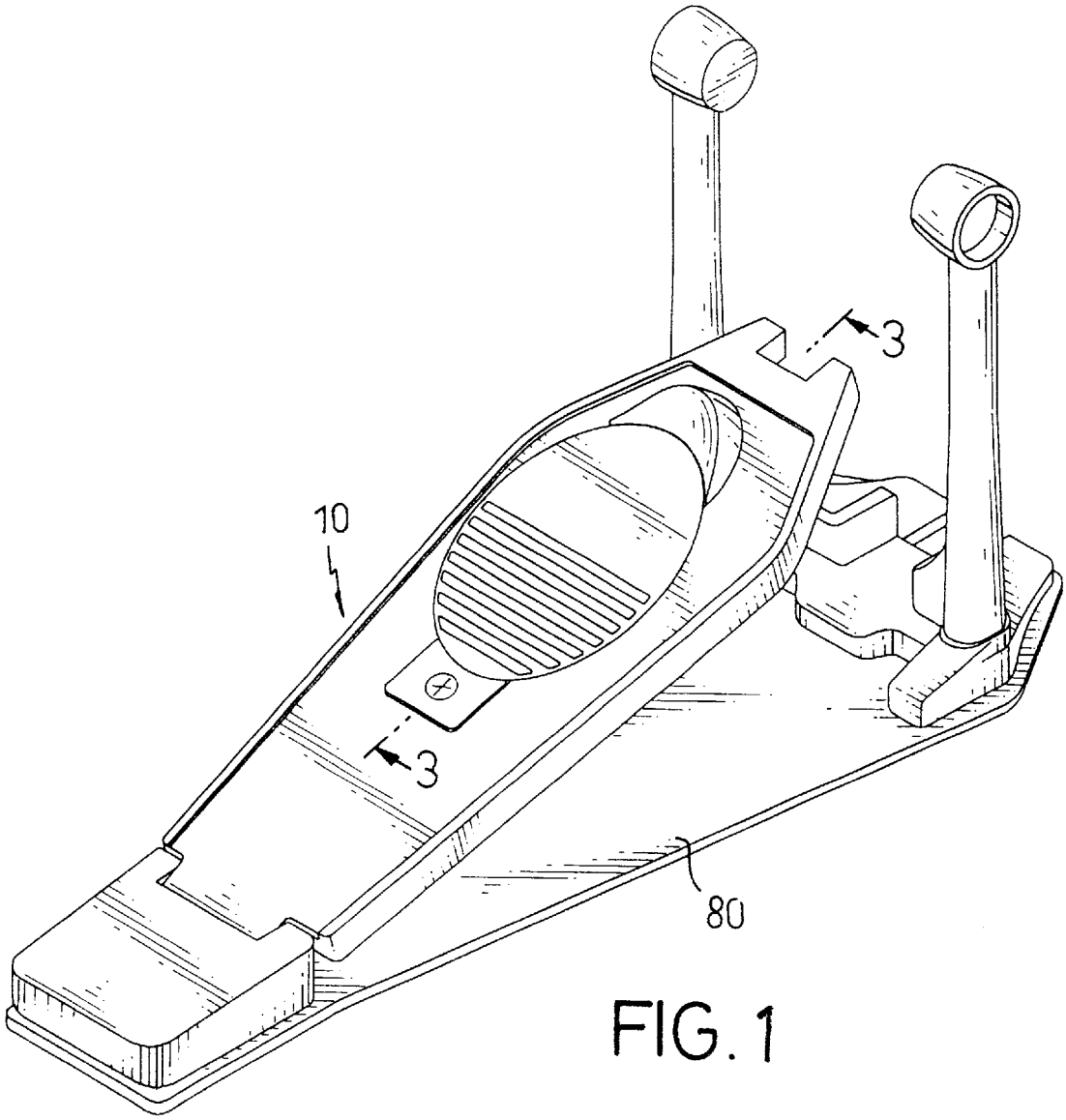
FIG. 1 is a perspective view of the instrument pedal of the present invention.
Figure 2:
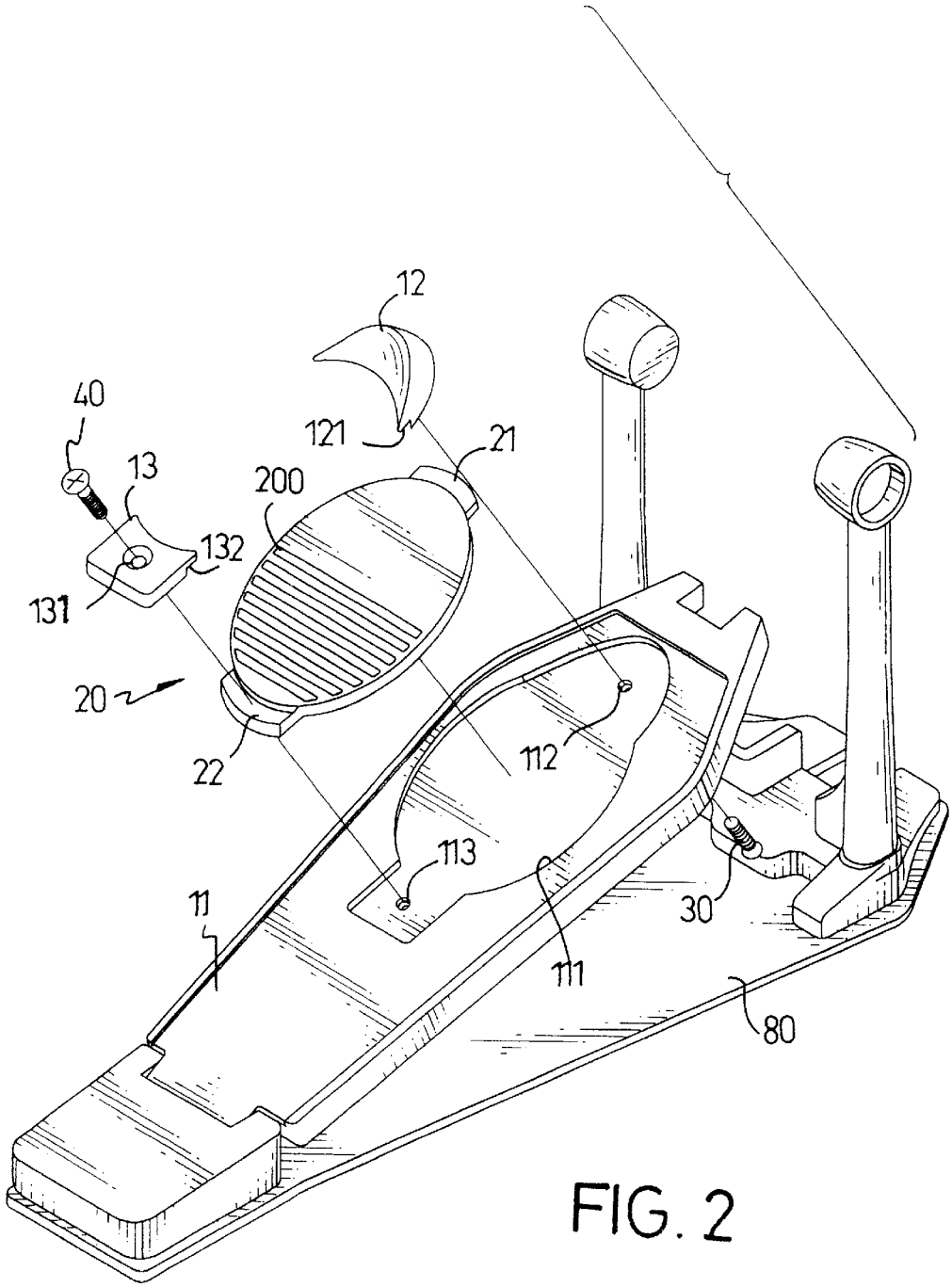
FIG. 2 is an exploded perspective view of the instrument pedal of FIG. 1.
Figure 3:
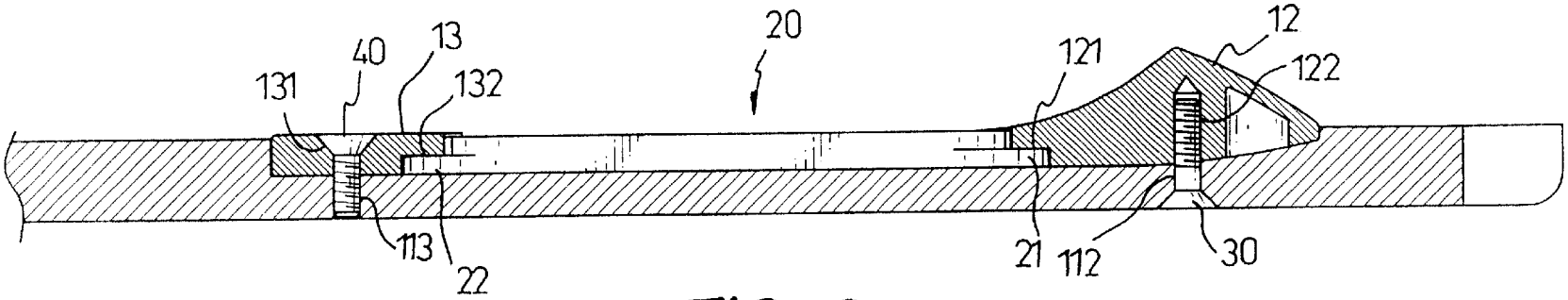
FIG. 3 is a cross sectional view of the instrument pedal of FIG. 1.

With reference to FIGS. 1, 2 and 3, the first embodiment of the instrument pedal (10) in accordance with the present invention is pivotally engaged with and inclined to a base (80). The pedal (10) of the present invention has a plate (11) and an auxiliary plate (20).

The plate (11) is inclined relative to the base (80) and is pivotally engaged with the base (80). The plate (11) has a recessed area (111) with a first through hole (112) and a second through hole (113) respectively defined in a bottom face defining the recessed area (111). The pedal (10) of the invention further has a stop (12) and a pressing plate (13) diagonally received in the recessed area (111). The stop (12) has a blind hole (122) defined in a bottom face of the stop (12) to align with the first through hole (112) and a first step (121). The pressing plate (13) has a through hole (131) defined to align with the second through hole (113) and a second step (132). Further, the auxiliary plate (20) is snugly 110 received in the recessed area (111) and has a first connecting flange (21) corresponding to the first step (121) and a second connecting flange (22) corresponding to the second step (132).

When the instrument pedal (10) of the present invention is assembled, the auxiliary plate (20) is first received in the recessed area (111) with the first step (121) receiving therein the first connecting flange (21) and the second step (132) receiving the second connecting flange (22). After the engagement between the steps (121,132) and the connecting flanges (21,22), the blind hole (122) of the stop (12) is aligned with the first through hole (112) and the through hole (131) of the pressing plate (13) aligned with the second through hole (113). Therefore, a first screw (30) is able to screw into the aligned first through hole (112) and the blind hole (122) from a bottom of the plate (11) to secure the engagement among the plate (11), the first connecting flange (21) and the stop (12). A second screw (40) is able to screw into the aligned second through hole (113) and the through hole (131) from the bottom of the plate (11) to secure the engagement among the plate (11), the second connecting flange (22) and the pressing plate (13). After the auxiliary plate (20), the stop (12) and the pressing plate (13) are received in the recessed area (111), the outer periphery of the combined stop (12), the auxiliary plate (20) and the pressing plate (13) is in conformance with the outer periphery of the recessed area (111). With such an arrangement, the auxiliary plate (20) is secured to the plate (11). Thus, when a pattern (200) on the auxiliary plate (20) is worn, the user only needs to replace the auxiliary plate (20) without replacing the entire pedal (10).

Figure 6:
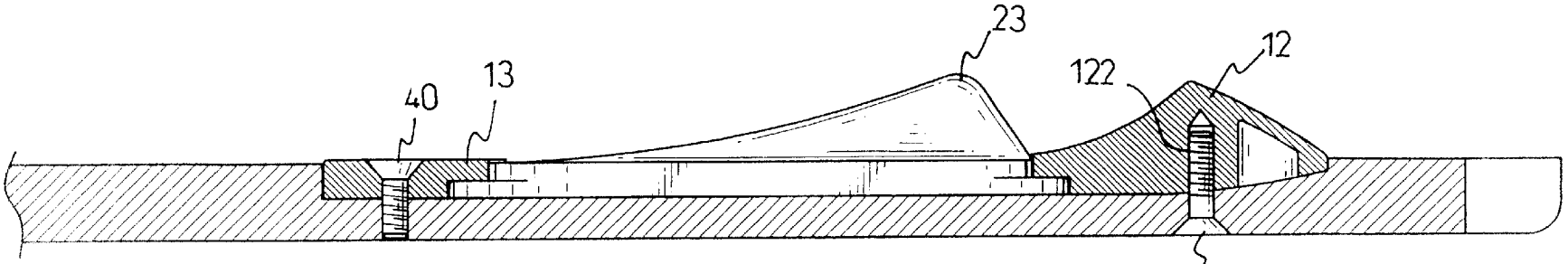
FIG. 6 is a cross sectional view of the instrument pedal of FIG. 4.
Figure 4:
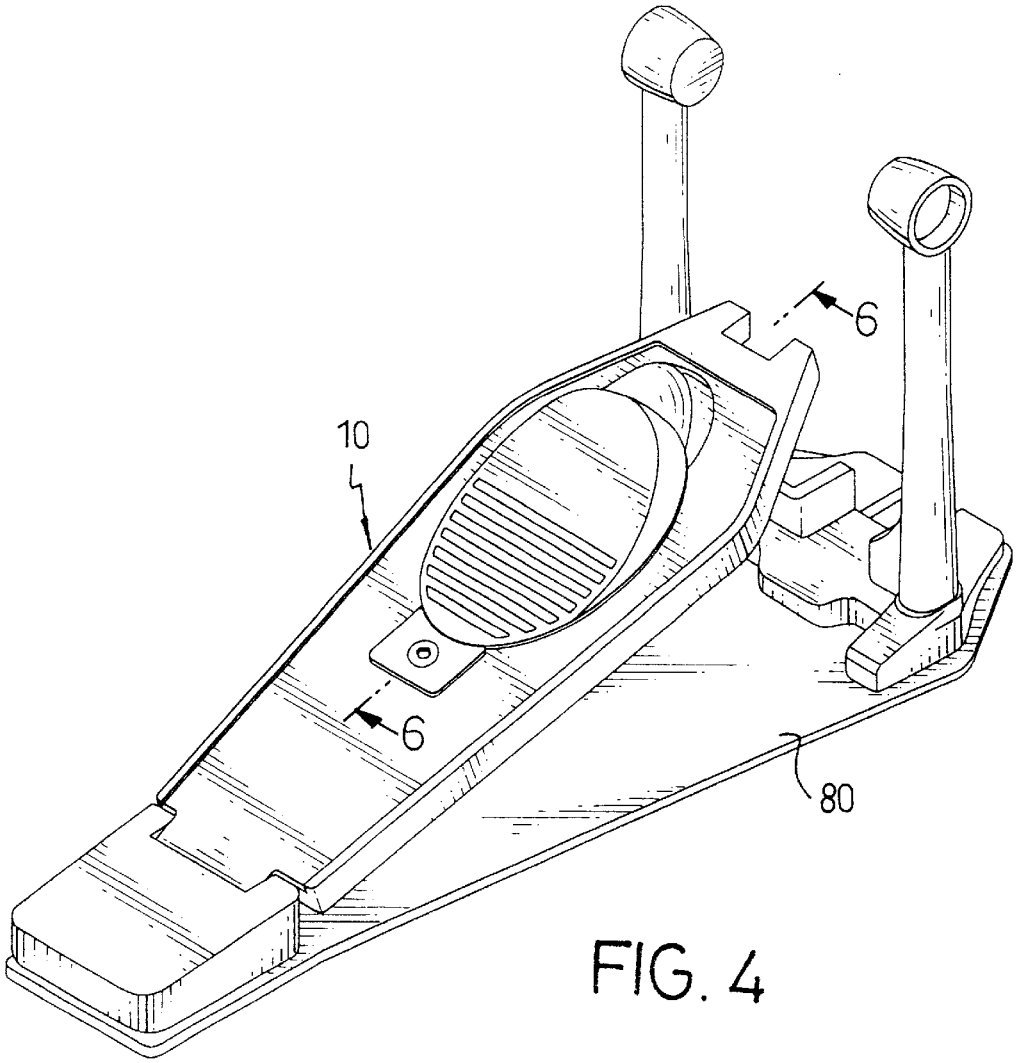
FIG. 4 is a perspective view of another embodiment of the instrument pedal of the present invention.
Figure 5:
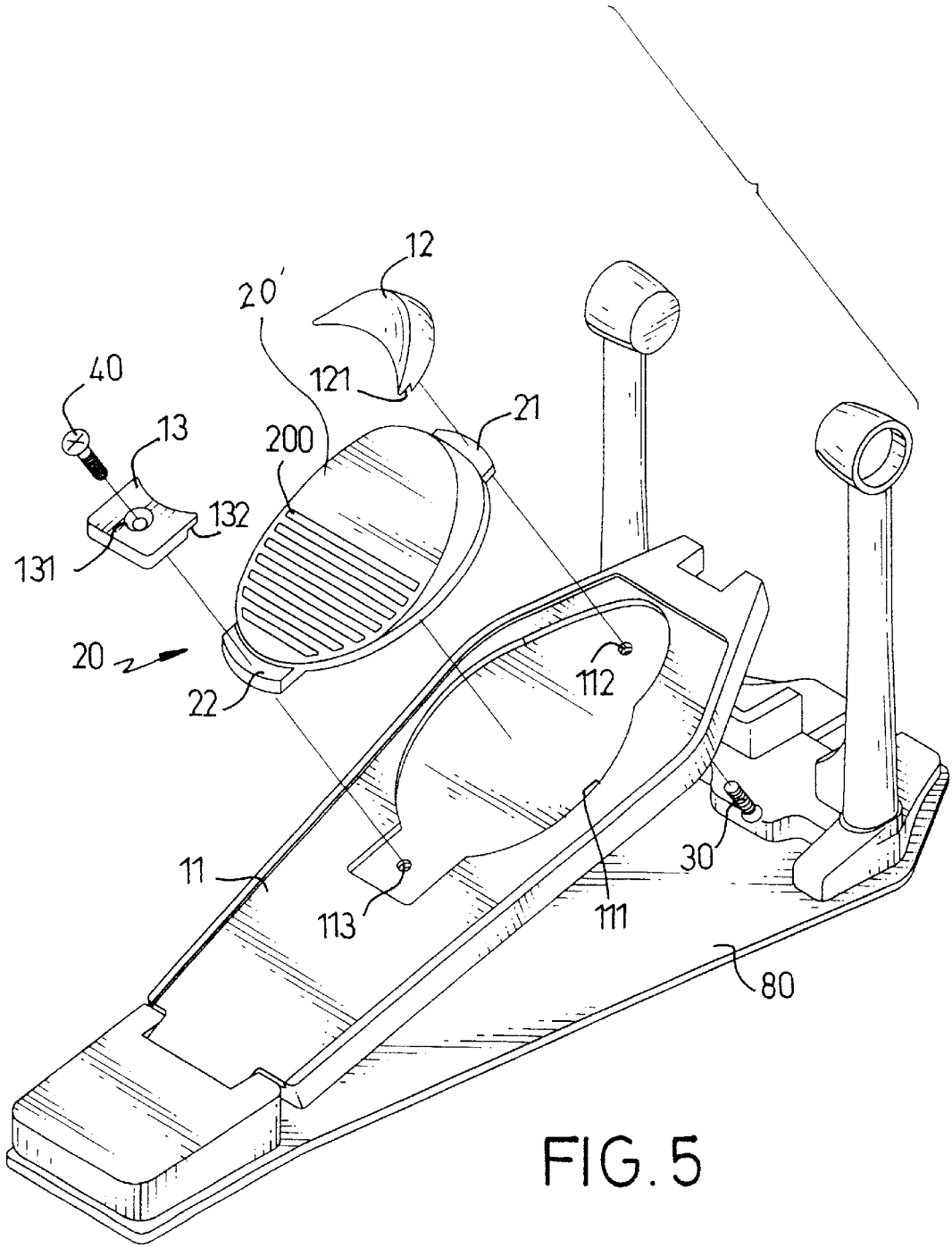
FIG. 5 is an exploded perspective view of the instrument pedal of FIG. 4.
Figure 7:
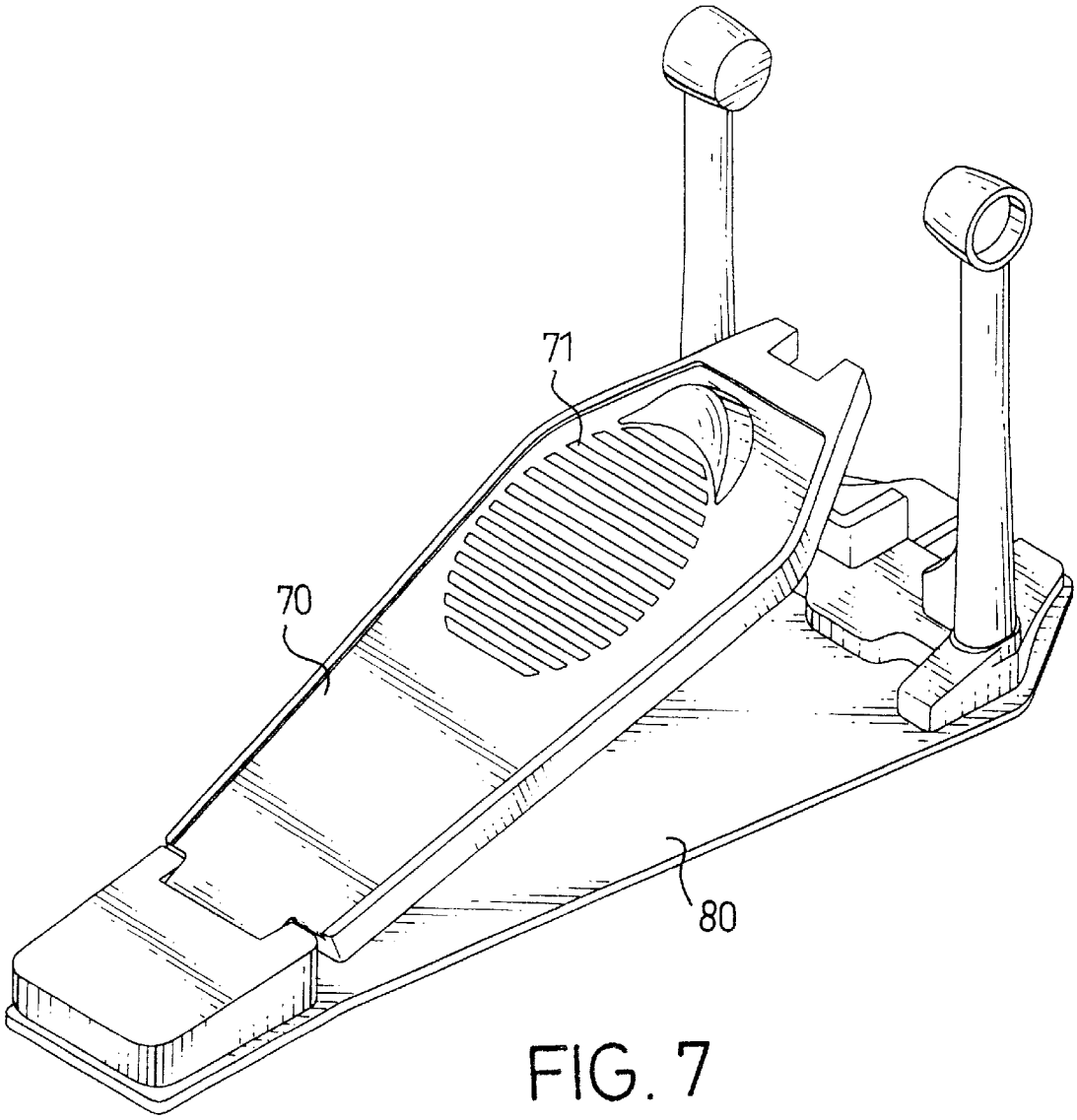
FIG. 7 PRIOR ART
FIG. 7 is a perspective view of a conventional instrument pedal.

With reference to FIGS. 4, 5 and 6, another embodiment of the present invention is shown. It is to be noted that most of the elements in this embodiment are identical to those shown in FIGS. 1, 2 and 3. No new reference numerals is to be designated to each of the identical elements and the same reference numerals are used for the same elements.

The plate (11) is inclined relative to the base (80) and is pivotally engaged with the base (80). The plate (11) has a recessed area (111) with a first through hole (112) and a second through hole (113) respectively defined in a bottom face defining the recessed area (111). The pedal (10) of the invention further has a stop (12) and a pressing plate (13) diagonally received in the recessed area (111). The stop (12) has a blind hole (122) defined in a bottom face of the stop (12) to align with the first through hole (112) and a first step (121). The pressing plate (13) has a through hole (131) defined to align with the second through hole (113) and a second step (132). Further, an auxiliary plate (20') is snugly received in the recessed area (111) and has a first connecting flange (21) corresponding to the first step (121) and a second connecting flange (22) corresponding to the second step (132). The auxiliary plate (20') is tapered so that the thickness of the auxiliary plate (20') is gradually increased with respect to the stop (12). With such an arrangement, when the user is using the pedal (10) of this embodiment, the auxiliary plate (20') provides an ergonomic feeling to the user. That is, the user is able to use the pedal (10) in a relaxed condition.

In conclusion, the present invention provides an economic effective way to maintain the pedal once the pedal is worn. The increase of thickness of the auxiliary plate (20') enables the user to experience the convenience and relax of using the pedal.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An instrument pedal having a base, the instrument pedal comprising:

a plate adapted to be inclined and pivotally connected to the base, the plate defining a recessed area;

an auxiliary plate with a pattern formed on a face of the auxiliary plate and being securely yet detachably received in the recessed area; and a stop engaging the auxiliary plate to secure the auxiliary plate in the recessed area;

wherein the auxiliary plate has a first connecting flange extending out to be engaged with the stop, wherein the stop has a first step defined to correspond to the first connecting flange, wherein the recessed area has a first through hole defined in a bottom face defining the recessed area and the stop has a blind hole corresponding to the first through hole so that a first screw is able to screw into the first through hole and the blind hole to secure the auxiliary plate and the stop in the recessed area.

2. The instrument pedal as claimed in claim 1 further comprising a pressing plate with a through hold defined therethrough and a second connecting flange diagonally extending out from the auxiliary plate to the first connecting flange, whereby the pressing plate is able to engage with the second connecting flange to secure the auxiliary plate in the recessed area.

3. The instrument pedal as claimed in claim 2, wherein the pressing plate has a second step defined to corresponding to the second connecting flange.

4. The instrument pedal as claimed in claim 3, wherein the recessed area has a second through hole defined in the bottom face defining the recessed area and the pressing plate has a through hole corresponding to the second through hole, whereby a second screw is able to screw through the through hole and the second through hole to secure the auxiliary plate in the recessed area.

5. The instrument pedal as claimed in claim 1, wherein the auxiliary plate is tapered.

6. The instrument pedal as claimed in claim 2, wherein the auxiliary plate is tapered.

* * * * *